United States Patent [19]

Saito et al.

[11] 4,295,652

[45] Oct. 20, 1981

[54] GOLF BALL

[75] Inventors: Tasuku Saito, Tokorozawa; Tutomu Noma, Higashimurayama; Tsutomu Matsunaga, Iruma; Nagayoshi Naito, Nagoya; Chiaki Tanaka, Chita; Motoki Hiratsuka, Nagoya, all of Japan

[73] Assignees: Bridgestone Tire Co., Ltd.; Toray Industries, Inc., both of Tokyo, Japan

[21] Appl. No.: 119,640

[22] Filed: Feb. 8, 1980

[30] Foreign Application Priority Data

Feb. 15, 1979 [JP] Japan ..... 54-16339

[51] Int. Cl.[3] ..... A63B 37/12

[52] U.S. Cl. ..... 273/235 R; 273/224; 260/998.14; 525/533

[58] Field of Search ..... 260/998.14; 525/533; 273/233, 235 R, 58 J, DIG. 9

[56] References Cited

U.S. PATENT DOCUMENTS 3,784,520 1/1974 Hoeschele ..... 525/533

3,940,146 2/1976 Little ..... 260/998.14

*Primary Examiner*—Allan Lieberman

*Attorney, Agent, or Firm*—Austin R. Miller

[57] ABSTRACT

A golf ball having a thread-wound core and a cover formed of a block copolyetherester comprising (A) a terephthalic acid unit, (B) a 1,4-butanediol unit, (C) a unit of a dicarboxylic acid, other than terephthalic acid, or a short-chain diol, other than 1,4-butanediol, having a number-average molecular weight of not more than 300 and (D) a poly(alkylene oxide)glycol unit having a number-average molecular weight of from 500 to 3000. Said golf ball exhibits excellent impact resilience and also exhibits good cutting resistance and "click".

7 Claims, No Drawings

GOLF BALL

The present invention relates to a golf ball having a thread-wound central core and, more specifically, it relates to a golf ball in which a block copolyetherester having a specified structure is used as an outer cover for the thread-wound central core.

Properties which are required for the cover of a golf ball are impact resilience sufficient to give a satisfactory flight distance, cutting resistance, qualitative feeling such as "click" when the ball is hit by the club, a good affinity for the thread-wound (or solid) core during the molding process and the like.

Used heretofore, as the cover materials of golf balls, are mainly trans-1,4-polyisoprene, such as guttapercha and balata. However, since these materials are expensive, various attempts have been made to develop new materials which can substitute for those materials as the cover materials of golf balls. Among these new materials, metallic salts of copolymers of ethylene and $\alpha,\beta$-unsaturated carboxylic acids, that is, so-called ionomers, are used as the replacement for balata, on a commercial scale. However, although the ionomers exhibit an especially excellent cutting resistance, the "click" and impact resilience thereof are inferior to those of the golf balls having the balata cover.

Accordingly, the objects of the present invention are to obviate the afore-mentioned promblems of the prior art and to provide an improved golf ball which exhibits superior impact resilience and also has satisfactory properties, other than the impact resilience, which are required for golf balls.

Other objects and advantages of the present invention will be apparent from the following description.

In accordance with the present invention, there is provided a golf ball comprising a thread-wound central core and an outer cover for the core, said cover being formed of, as a main ingredient, a block copolyetherester comprising (A) a terephtalic acid unit, (B) a 1,4-butanediol unit, (C) a unit of a dicarboxylic acid, other than terephthalic acid, or a short-chain diol, other than 1,4-butanediol, having a number-average molecular weight of not more than 300 and (D) a poly(alkylene oxide)glycol unit having a number-average molecular weight of from 500 to 3000, the amount of the component (C), in terms of mol ratio to the component (A) or (B) being 25/75 through 60/40 and the amount of the component (D) being 35 through 70% by weight based on the total weight of the copolymer.

The golf ball according to the present invention has an advantage in that the flight distance of the ball is increased due to the high impact resilience thereof. Furthermore, since the specific gravity of the cover material of the present invention is larger than that of the conventional cover materials, such as balata or ionomer, the weight of the core of the golf ball should be reduced, so that the moment of inertia of the golf ball becomes larger compared with the conventional balls. Thus, when the ball is struck by the club, appropriate spin is put on the ball and the trajectory of the ball becomes stable compared with the conventional balls.

As mentioned hereinabove, the block copolyetherester used, as the cover for the thread-wound core, in the present invention comprises the following four components:

(A) terephthalic acid (B) 1,4-butanediol (C) dicarboxylic acids, other than terephthalic acid, or diols, other than 1,4-butanediol, having a low molecular weight, and (D) poly(alkylene oxide)glycol having a number-average molecular weight of from 500 to 3000.

In the block copolyetherester of the present invention, short-chain ester hard segments are composed of the copolyester which is derived from (A) terephthalic acid, (B) 1,4-butanediol and (C) dicarboxylic acids, other than terephthalic acid, or diols, other than 1,4-butanediol, having a low molecular weight.

The dicarboxylic acids, other than terephthalic acid, used as the component (C) in the present invention include: aromatic dicarboxylic acids such as isophthalic acid, phthalic acid, naphthalene-2,6-dicarboxylic acid, naphthalene-2,7-dicarboxylic acid, diphenyl-4,4'-dicarboxylic acid, diphenoxyethane dicarboxylic acid and 5-sulfoisophthalic acid; alicyclic dicarboxylic acids such as 1,4-cyclohexane dicarboxylic acid; and aliphatic dicarboxylic acids such as succinic acid, oxalic acid, adipic acid, sebacic acid, dodecanoic acid and dimer acid. These acids can be used alone or in any mixture thereof. It should be noted that ester-forming derivatives of these dicarboxylic acids such as, for example, the lower alkyl esters, the aryl esters, the carbonate (or carbonic acid ester) and the acid halides can also be used as the component (C) in the present invention.

The diols, other than 1,4-butanediol, used as the component (C) in the present invention include those having a molecular weight of 300 or less. Examples of such diols are: aliphatic diols such as ethylene glycol, trimethylene glycol, pentamethylene glycol, hexamethylene glycol, neopentyl glycol and decamethylene glycol; alicyclic diols such as 1,1-cyclohexane dimethanol, 1,4-cyclohexane dimethanol and tricyclodecane dimethanol; and diols containing aromatic group(s) such as xylylene glycol, bis(p-hydroxy)diphenyl, bis(p-hydroxyphenyl)propane, 2,2-bis 4-(2-hydroxyethoxy)phenyl]-propane, 2,2-bis[4-(2-hydroxyethoxy)phenyl]propane, bis[4-(2-hydroxy)phenyl]sulfone and, 1,1-bis[4-(2-hydroxyethoxy)phenyl]cyclohexane. These diols can be used alone or in any combination thereof. It should be noted that ester-forming derivatives of these diols such as, for example, the acetylated derivatives and the alkali metal salts can also be used as the component (C) in the present invention.

Among the components (A), (B) and (C) which form the hard segment of the block copolyetherester of the present invention, the components (A) and (B) serve as the components to improve the impact resilience, the hardness and the cutting resistance. These properties are required for the cover of golf balls. However, block copolyetherester having the hard segment derived from only the components (A) and (B) exhibits a high melting point and poor moldability. For this reason, an appropriate amount of the component (C) is added, according to the present invention. The addition of the component (C) also increases the cutting resistance of the golf balls. However, when the addition amount of the component (C) is too large, an unpreferable decrease in the hardness of the copolyetherester is caused. Furthermore, the cutting resistance and the initial velocity are also undesirably decreased. For these reasons, the component (C) should be used in an amount of, in terms of mol ratio to the component (A) or (B), 25/75 through 60/40, and preferably 32/68 through 50/50.

The component (D), i.e. poly(alkylene oxide)glycol having a number-average molecular weight of from 500 to 3000 forms the soft segments of the block copolyetherester. Examples of those poly(alkylene oxide)glycol are polyethylene glycol, poly(1,2- and 1,3-propylene oxide)glycol, poly(tetramethylene oxide) glycol, copolymer of ethylene oxide and propylene oxide and the copolymer of ethylene oxide and tetrahydrofuran. These poly(alkylene oxide)glycols can be used alone or in any combination thereof. Among these compounds, the most preferable poly(alkylene oxide)glycol is poly(-tetramethylene oxide)glycol from the point of view of the properties, especially, the tear strength and the impact resilience of the material. The amount of the soft segments in the block copolyetherester may be widely varied depending on, for example, the copolymerization ratio of the polyester hard segments and the desired hardness of the golf balls. However, the decrease in the impact resilience and the decrease in the hardness are caused in the case where the amount of the component (D) is either too large or too small. Accordingly, the amount of the component (D) in the block copolyetherester is within the range of from 35 to 70% by weight, and preferably 35 to 60% by weight, based on the total weight of the block copolyetherester.

The copolyetherester comprising said four components (A), (B), (C) and (D) can be prepared in any conventional method. For instance, the lower alcohol diester of dicarboxylic acid, an excess amount of the glycol having a low molecular weight and an excess amount of the poly(alkylene oxide)glycol are subjected to an ester interchange reaction in the presence of a catalyst, and the resultant reaction products are then subjected to a polycondensation reaction. Alternatively, the dicarboxylic acid is esterified in the presence of a catalyst with the glycol and the poly(alkylene oxide)glycol and the product so obtained is subjected to a polycondensation reaction. Further, after polybutylene terephthalate is previously prepared in a known manner, the other dicarboxylic acid and the diol or the poly(alkylene oxide)-glycol are added to the polybutylene terephthalate to effect the randomization of polybutylene terephthalate with the components. Furthermore, to the previously prepared polyester, such as copolyetherester, the other copolyester is added to effect the randomization of both copolyesters by an ester interchange reaction.

As the catalysts commonly used in the esterification or ester interchange reaction and the polycondensation reaction, titanium catalysts can be advantageously used due to the fact that good results are obtained. Especially, tetraalkyl titanate, such as tetrabutyl titanate, metal salts of titanium oxalate, such as potassium titanium oxalate and the like can be preferably used. Examples of the other catalysts used in the preparation of the block copolyetherester of the present invention are tin compounds, such as dibutyltin oxide and dibutyltin laurate, and lead compounds, such as lead acetate.

In the block copolyetherester of the present invention, a portion of the dicarboxylic acids or the glycols can be replaced with polycarboxylic acids or polyfunctional hydroxy compounds and oxyacids. These copolymerized polyfunctional components effectively serve as an agent for increasing the viscosity of the block copolyetherester of the present invention. These polyfunctional components can be used in an amount of 3 mol% or less based on the total weight of the block copolyetherester. Examples of such polyfunctional components are trimellitic acid, trimesic acid, pyromellitic acid, benzophenone tetracarboxylic acid, butane tetracarboxylic acid, glycerine, pentaerythritol and the esters and acid anhydrides thereof.

The composition used in the formation of the golf ball covers of the present invention can additionally contain various conventional additives. There may be used fillers exemplified by graphite, chopped glass fiber, chopped synthetic fiber such as polyester fiber, inorganic fibrous filler such as asbestos, glass flake, titanium dioxide, zinc oxide, magnesium oxide, finely divided silica hydrate, lead carbonate, calcium carbonate, clays, alumina, litharge and baryte, nucleating agents such as alkaline earth metal carbonates, the sodium salts of higher fatty acids, the sodium salt of montan wax acid and powdered polybutylene terephthalate, and lubricants such as hydrocarbon type waxes, fatty acids, fatty acid amides, bis-fatty acid amides, ester waxes and metallic soaps.

Conventional heat and radiation stabilizing agents, such as antioxidants and ultraviolet light absorbents (UV absorbers), can also be incorporated into the compositions for molding the golf ball covers of the present invention.

The heat stabilizing agents which can be used in the present invention include, for example, various hindered phenols, such as 4,4'-bis(2,6-ditertiary butyl phenol), 1,3,5-trimethyl-2,4,5-tris(3,5-ditertiary butyl-4-hydroxybenzyl)benzene, tetrakis[methylene-3(3,5-ditertiary butyl-4-hydroxy phenyl)propionate]methane and N, N'-hexamethylene-bis(3,5-ditertiary butyl-4-hydroxyhydro cinnamic acid amide); aromatic amines such as N, N'-bis($\beta$-naphtyl)-p-phenylene diamine and 4,4'-bis(4-$\alpha$,$\alpha$-dimethyl benzyl)diphenyl amine; sulfur compounds such as dilauryl thiodipropionate; phosphorous compounds; alkaline earth metal oxides; the nickel salt of the Schiff bases. Examples of the radiation stabilizing agents are substituted benzophenones, benzotriazoles and piperidine compounds such as bis(2,2,6,6-tetramethyl-4-piperidine)sebacate and 4-benzoyloxy-2,2,6,6-tetramethyl piperidine.

The golf balls of the present invention can be manufactured in any conventional manner. For instance, after the above-mentioned various ingredients are added to the block copolyetherester to prepare the composition, the composition thus obtained is molded to a sheet and, then, the sheet is fabricated or shaped in a cold state to form half-cups or half-shells. However, the half-shells can be advantageously and directly injection molded, without being formed into sheets, from the composition containing the block copolyetherester. A thread-wound core is placed between two half-shells and the ball assembly thus obtained is, then, molded under a pressure of at least 0.5 ton per ball at a temperature of 130° through 180° C. to form the golf ball of the present invention. Otherwise, the golf ball of the present invention can also be prepared by placing the thread-wound core in the center of a mold cavity and then injecting the composition containing the block copolyetherester to form the golf ball of the present invention.

Since the specific gravity of the block copolyetherester used in the present invention is larger than those of the balata and ionomers which are the conventional cover materials, the total weight of the golf ball is adjusted by reducing the weight of the thread-wound core so as to maintain the total weight constant. The conventional golf ball core is composed of a rubber sphere filled with a liquid substance therein or a solid sphere made of an elastic substance such as cis-polybutadiene.

However, according to the present invention, since the amount of the fillers contained in the core, such as zinc oxide, titanium oxide, calcium carbonate and barium sulfate is reduced to adjust the total weight of the golf balls, the impact resilience of the golf ball core is desirably increased. Furthermore, since the moment of inertia of the ball thus manufactured becomes high, when the ball is struck by the club, appropriate spin is put on the ball and, therefore, the trajectory of the ball becomes stable.

The present invention is further illustrated in detail by, but is by no means limited to, the following examples in which all parts and percentages are expressed on a weight basis, unless otherwise specified.

EXAMPLE 1

A block copolyetherester was prepared as follows from (A) terephthalic acid, (B) 1,4-butanediol, (C) isophthalic acid and (D) poly(tetramethylene oxide glycol) having a number-average molecular weight of 1000.

Into a glass flask having a stainless steel stirrer with helical ribbon type screw, 108 parts of terephthalic acid 135 parts of 1,4-butanediol, 58 parts of isophthalic acid and 147 parts of poly(tetramethylene oxide)glycol having a molecular weight of about 1000 were placed together with 0.08 parts of tetrabutyl titanate. The mixture was heated with stirring at 210° C. for 2 hours, while distilling off water from the reaction mixture. The reaction temperature was then raised to 245° C. and the pressure on the system was reduced to 0.1 mmHg for a period of 60 minutes. Polymerization was continued for 3 hours under these conditions. The specific gravity of the block copolyetherester thus obtained was 1.18 and the melting point thereof was 139° C. The content of the component (D) based on the total copolymer weight was 40%.

3 Parts of titanium dioxide was added, as a whitening agent, to 100 parts of the block copolyetherester. The composition thus obtained was mixed and, then, molded on an injection machine having a cylinder temperature of 180° C. to form covers in the form of half-shells having a wall thickness of 2 mm.

The golf balls were then prepared by placing a thread-wound core mainly containing, cis-1,4-polybutadiene between the two half-shells and, then, molded in a mold for golf balls under a pressure of 1.5 ton per ball, at a temperature of 165° C. for 2 minutes. Thus, golf balls having a weight of 45.5 g and a diameter of 41.15 mm were obtained.

The initial velocity and the trajectory of the balls thus obtained were evaluated by using a golf ball hitting test machine manufactured by TRUE TEMPER Corp. The test was carried out under the conditions of the club head speed of 45 m/sec (a No. 1 wood club was used) and the ball temperature of 20° C. The results are shown in Table 1 below. The cutting resistance was also determined by using the same test machine as described above. The marks caused in the surface of the ball after having been hit with a No. 7 iron club at a pressure of 7 kg/cm$^2$ were observed with the naked eye. The result are also shown in Table 1 below.

The initial velocity, the trajectory, the cutting resistance and the "click" property of the balls thus evaluated were all good and satisfactory.

EXAMPLES 2 THROUGH 7

Various copolyetheresters were prepared in a manner as described in Example 1, except that the contents of the components (C) and (D) were changed as shown in Table 1. Golf balls were prepared from the copolyetheresters thus obtained and evaluated in a manner as described in Example 1. The properties of the resins and the properties of the golf balls so obtained are shown in Table 1 below.

As is clear from the results shown in Table 1, the initial velocities of the balls prepared in Examples 1 through 7 are larger than those of commercially available golf balls having balata covers or Surlyn covers (Please refer to the following Comparative Examples 5 and 6).

COMPARATIVE EXAMPLE 1 THROUGH 4

Copolyetheresters were prepared in a manner as described in Example 1, except that the contents of the components (C) and (D) were changed. Golf balls were manufactured from these copolyetheresters and evaluated in a manner as described in Example 1. The results are shown in Table 1.

TABLE 1

| | | Example | | | | | | | Comparative Example | | | |
|---|---|---|---|---|---|---|---|---|---|---|---|---|
| | | 1 | 2 | 3 | 4 | 5 | 6 | 7 | 1 | 2 | 3 | 4 |
| Resin Composition | Isophthalic Acid/ Terephthalic Acid (mol ratio) | 35/65 | 40/60 | 40/60 | 30/70 | 30/70 | 30/70 | 55/45 | 45/55 | 20/80 | 0/100 | 20/80 |
| | Content of Component (D)* (%) | 40 | 40 | 50 | 50 | 40 | 65 | 40 | 30 | 30 | 65 | 50 |
| | Specific gravity | 1.18 | 1.17 | 1.15 | 1.16 | 1.18 | 1.11 | 1.17 | 1.20 | 1.21 | 1.12 | 1.16 |
| Resin Property | Melting Point (°C.) | 139 | 128 | 122 | 147 | 152 | 115 | 105 | 132 | 180 | 179 | 165 |
| | JIS Hardness | 91 | 91 | 86 | 89 | 92 | 84 | 86 | 90 | 94 | 92 | 90 |
| | Resilience (%) | 56.1 | 54.5 | 59.0 | 64.2 | 57.5 | 60.0 | 48.0 | 42.5 | 42.0 | 63.5 | 59.5 |
| | Initial Velocity (m/sec) | 67.2 | 67.1 | 66.8 | 67.3 | 66.8 | 67.3 | 67.0 | 66.3 | could not be molded | could not be molded | 67.7 |
| Ball Property | Cutting Resistance | good | good | excellent | good | good | good | good | good | — | — | bad |
| | Click | good | good | good | good | good | good | good | good | — | — | good |
| | Trajectory (compared with balata ball) | good | good | good | good | good | good | good | good | — | — | good |
| | Ball Weight | 45.5 | 45.7 | 45.3 | 45.6 | 45.6 | 45.2 | 45.6 | 45.6 | — | — | 45.6 |

*poly(tetramethylene oxide)glycol having a number-average molecular weight of about 1000

EXAMPLE 8

A block copolyetherester having a specific gravity of 1.18 and a melting point of 142° C. was prepared from terephthalic acid, phthalic acid, 1,4-butanediol and poly(tetramethylene oxide)glycol in a manner as described in Example 1. The ratio of terephthalic acid to the phthalic acid in the copolyetherester was 60/40 (mol ratio) and the content of poly(tetramethylene oxide)glycol was 40% by weight.

From the block copolyetherester thus obtained, golf balls having a weight of 45.6 g were manufactured and evaluated in a manner as described in Example 1. The results are as follows.

| | |
|---|---|
| Initial Velocity (m/sec) | 66.9 |
| Cutting Resistance | Good |
| "Click" | Good |
| Trajectory (compared with Balata Ball) | Good |

COMPARATIVE EXAMPLE 5

Commercially available golf balls each comprising a thread-wound core and a balata cover (the diameter was 41.20 mm and the weight was 45.3 g) were evaluated in a manner as described in Example 1. The initial velocity was 66.1 m/sec. The cutting resistance and the "click" thereof were good.

COMPARATIVE EXAMPLE 6

Commercially available golf balls each comprising a thread-wound core and an ionomer cover (the diameter was 41.15 mm and the weight was 45.4 g) were evaluated in a manner as described in Example 1. The initial velocity was 66.0 m/sec. The cutting resistance was good, but the "click" was too sharp.

What we claim is:

1. A golf ball comprising a thread-wound central core and an outer cover for the core, said cover being formed of, as a main ingredient, a block copolyetherester comprising (A) a terephthalic acid unit, (B) a 1,4-butanediol unit, (C) a unit of a dicarboxylic acid, other than terephthalic acid, or a short-chain diol, other than 1,4-butanediol, having a number-average molecular weight of not more than 300 and (D) a poly(alkylene oxide) glycol unit having a number-average molecular weight of from 500 to 3000, the amount of the component (C), being 25/75 through 60/40 in terms of mol ratio to either component (A) or (B), and the amount of the component (D) being 35 through 70% by weight based on the total weight of the copolymer.

2. A golf ball as claimed in claim 1, wherein said dicarboxylic acid, other than terephthalic acid, is selected from the group consisting of isophthalic acid, phthalic acid, naphthalene-2,6-dicarboxylic acid, naphthalene-2,7-dicarboxylic acid, diphenyl-4,4'-dicarboxylic acid, diphenoxyethane dicarboxylic acid and 5-sulfoisophthalic acid.

3. A golf ball as claimed in claim 1, wherein said dicarboxylic acid, other than terephthalic acid, is selected from the group consisting of 1,4-cyclohexane dicarboxylic acid, succinic acid, oxalic acid, adipic acid, sebacic acid, dodecanoic acid and dimer acid.

4. A golf ball as claimed in claim 1, wherein said diol, other than 1,4-butanediol, is selected from the group consisting of ethylene glycol, trimethylene glycol, pentamethylene glycol, hexamethylene glycol, neopentyl glycol and decamethylene glycol.

5. A golf ball as claimed in claim 1, wherein said diol, other than 1,4-butanediol, is selected from the group consisting of 1,1-cyclohexane dimethanol, 1,4-cyclohexane dimethanol and tricyclodecane dimethanol.

6. A golf ball as claimed in claim 1, wherein said diol, other than 1,4-butanediol, is selected from the group consisting of xylylene glycol, bis(p-hydroxy)diphenyl, bis(p-hydroxyphenyl)propane, 2,2-bis[4-(2-hydroxyethoxy)phenyl]propane, bis[4-(2-hydroxy)phenyl]sulfone and 1,1-bis[4-(2-hydroxyethoxy)phenyl]cyclohexane.

7. A golf ball as claimed in claim 1, wherein said poly(alkylene oxide)glycol unit is derived from polyethylene glycol, poly(1,2-propylene oxide)glycol, poly(1,3-propylene oxide)glycol, poly(tetramethylene oxide)glycol, a copolymer of ethylene oxide and propylene oxide and a copolymer of ethylene oxide and tetrahydrofuran.

* * * * *